US006149045A

United States Patent [19]

Kadono

[11] Patent Number: 6,149,045

[45] Date of Patent: Nov. 21, 2000

[54] PAPER SHEET SUPPLYING APPARATUS HAVING A RAISED CENTRAL REGION FOR PREVENTING A PAPER SHEET FROM SKEWING AS THE SHEET IS FED

[75] Inventor: Takeshi Kadono, Kawaguchi, Japan

[73] Assignee: Toshiba Tec Kabushiki Kaisha, Tokyo, Japan

[21] Appl. No.: 09/267,886

[22] Filed: Apr. 2, 1999

Related U.S. Application Data

[63] Continuation-in-part of application No. 08/955,714, Oct. 22, 1997, abandoned, which is a continuation of application No. 08/644,657, Apr. 24, 1996, abandoned.

[30] Foreign Application Priority Data

Apr. 26, 1995 [JP] Japan ..... 7-101959

[51] Int. Cl.[7] ..... B65H 23/032; B65H 23/035; B65H 5/00; B65H 29/70

[52] U.S. Cl. ..... 226/196.1; 226/88; 242/615; 242/615.4; 271/225; 271/188

[58] Field of Search ..... 226/196.1, 88; 242/615, 615.3, 615 A, 548, 566; 271/10.11, 10.12, 225, 264, 188

[56] References Cited

U.S. PATENT DOCUMENTS

| | | | |
|---|---|---|---|
| 1,638,560 | 8/1927 | Beveridge | 226/88 |
| 2,622,448 | 12/1952 | Lorig | 226/196 X |
| 3,494,525 | 2/1970 | Wiig | 226/196 X |
| 3,942,735 | 3/1976 | Marchio et al. | 242/548 X |
| 4,635,920 | 1/1987 | Kodama | 271/225 X |
| 4,699,365 | 10/1987 | Smith et al. | 271/225 X |
| 4,813,612 | 3/1989 | Kano et al. | 271/10.11 |
| 4,994,864 | 2/1991 | Schieck et al. . | |
| 5,662,321 | 9/1997 | Borostyan et al. | 271/10.12 X |

FOREIGN PATENT DOCUMENTS

| | | | |
|---|---|---|---|
| 0 579 168 | 1/1994 | European Pat. Off. . | |
| 59-203053 | 11/1984 | Japan | 271/188 |
| 4-146456 | 5/1992 | Japan . | |
| 60-01514 | 1/1994 | Japan . | |
| 8-295439 | 11/1996 | Japan . | |

*Primary Examiner*—Daniel P. Stodola
*Assistant Examiner*—Gregory J. Strimbu
*Attorney, Agent, or Firm*—Frishauf, Holtz, Goodman, Langer & Chick, P.C.

[57] ABSTRACT

A paper sheet supplying apparatus comprises a transfer guide unit, a register unit and a paper sheet sending-out unit. The supplying apparatus supplies a paper sheet through the transfer guide unit to the register unit from the paper sheet sending-out unit. The guide unit has a straight portion and a curved portion, and guides the paper sheet from the sending-out unit to the register unit. An inwardly indented curved surface of the curved portion, on which the paper sheet is in contact, has a plurality of ribs separated from each other. Not more than three ribs of the plurality of ribs are arranged in a center region of the curved surface in the transfer direction, and the remaining ribs of the plurality of ribs are arranged in each side region located proximate the center region. Each of the ribs in the center region has a first height, and each rib in each side region has a height which is smaller than the first height.

5 Claims, 4 Drawing Sheets

PAPER SHEET SUPPLYING APPARATUS HAVING A RAISED CENTRAL REGION FOR PREVENTING A PAPER SHEET FROM SKEWING AS THE SHEET IS FED

CROSS-REFERENCE TO RELATED APPLICATIONS

This is a Continuation-in-Part application of U.S. Ser. No. 08/955,714, filed Oct. 22, 1997, now abandoned, which is a continuation application of U.S. patent application Ser. No. 08/644,657, filed Apr. 24, 1996, abandoned, the entire contents of applications Ser. Nos. 08/955,714 and 08/644,657 being incorporated herein by reference.

BACKGROUND OF THE INVENTION

The present invention relates to a recording medium supplying apparatus having a raised central region for preventing a recording medium from skewing as the medium is fed.

The above described apparatus is used for supplying a recording medium such as a sheet having a predetermined size to a register unit arranged in front of a printing unit in a copying machine or facsimile apparatus.

FIG. 8 schematically shows a structure of the conventional apparatus of the above described kind. As shown in FIG. 8, the conventional apparatus comprises a recording medium sending-out unit 10 for sending out a paper sheet P, and a recording medium transfer guide unit 16 for guiding the sheet P sent out from the sending-out unit 10 to a register unit 14 arranged in front of a printing unit 12. In the conventional apparatus of FIG. 8, the register unit 14 is structured by a pair of register rollers 14*a*.

The recording medium sending-out unit 10 comprises a recording medium cassette 10*a* containing a plurality of sheets P in a stacked state, a pickup roller 10*b* contacting an upper surface of an uppermost sheet P in the plurality of the sheets in the cassette 10*a* at a position near an inlet opening of the recording medium transfer guide unit 16 and selectively moving the uppermost sheet P toward the inlet opening, and a sending-out roller 10*c* for sending out the uppermost sheet P moved toward the inlet opening by the pickup roller 10*b*, into the recording medium transfer guide unit 16 through the inlet opening.

The recording medium transfer guide unit 16 includes a pair of guide members 16*a* and 16*b* which face each other with a gap much larger than the thickness of the sheet P. The guide member 16*a* has a portion constantly and slidingly contacting the sheet P to guide the transfer of the sheet P. A sliding contact surface of the portion of the guide member 16*a* has a comb-teeth like cross section as shown in FIG. 9 in order to reduce a sliding friction generating between the sliding contact surface and the sheet P. Projecting end surfaces of the ribs 18, the ribs 18 structuring the sliding contact surface of the comb-teeth like cross section of the guide member 16*a*, are placed on the same plane so that all of the projecting end surfaces of the ribs 18 covered by the sheet P slidingly contacting the sliding contact surface of the guide member 16*a* contact the sheet P.

The register unit 14 is arranged near an outlet of the recording medium transfer guide unit 16, and a length of a sheet transferring passage from the sending-out roller 10*c* to the register unit 14 via the recording medium transfer guide unit 16 is shorter than a length of the sheet P measured in its moving direction.

The sheet P discharged from the outlet of the recording medium transfer guide unit 16 abuts its leading end on a contact line between the paired register rollers 14*a*, 14*a* of the register unit 14. If the sheet P skews at this time with regard to the contact line as shown in FIG. 10, a moment M will be produced in the sheet P which is applied with a moving force F by the sending-out roller 10*c*, to turn the sheet P around at one corner L of the leading end contacting the contact line and to move another corner R of the leading end not contacting the contact line toward the contact line.

Whether the sheet P skews or not, the register unit 14 is driven to send out the sheet P toward the printing unit 12 after a sufficient time for correcting the skew of the sheet P has passed from a time when the sheet P is sent out from the cassette 10*a*. The printing unit 12 prints an image on the sheet P reached thereto on the basis of printing information supplied to the printing unit 12 in advance.

Even after the leading end of the sheet P has reached the contact line between the paired register rollers 14*a*, 14*b* of the register unit 14, the sheet P is still applied with the moving force F by the sending-out roller 10*c*, and thus the sheet P is bent due to the moving force F. The bend may easily occur, particularly in a portion at which the moving direction of the sheet P is changed in the sheet transferring passage in the recording medium transfer guide unit 16, i.e., in a bending portion of the transfer guide unit 16. A peak of the bend is strongly pushed against the projecting end surfaces of the ribs 18 of the guide member 16*a*. The bend of the sheet P is shown in FIG. 8 by a dotted line.

In the conventional apparatus structured as described above, the friction produced between the sheet P and each of the projecting end surfaces of the ribs 18 is substantially equal to each other. Therefore, if the sheet P skews, a turn of the sheet P for correcting the skew of the sheet P cannot be easily generated because the peak of the bend is strongly pushed against the projecting end surfaces bf the ribs 18 of the guide member 16*a*.

As a result of this, the sheet P may be supplied to the printing unit 12 without the skew of the sheet P being corrected by the register unit 14, so that an image may be printed on the sheet P in a wrong position or wrinkles of the sheet P may be generated in the sheet P, the wrinkles being able to clog the sheet P in the sheet transferring passage.

BRIEF SUMMARY OF THE INVENTION

This invention is derived from the above described circumstances, and an object of the present invention is to provide a recording medium supplying apparatus which can always surely correct a skew of a recording medium by a register unit, and can always surely prevent a decrease in printing quality on the recording medium, generation of wrinkles in the recording medium, and clogging of the recording medium in a recording medium transferring passage.

In order to achieve the object, a recording medium supplying apparatus according to the present invention comprises a paper sheet sending-out unit which sends out a paper sheet as a recording medium, and a paper sheet transfer guide unit which guides a transfer of the paper sheet sent out by the sending-out unit.

The paper sheet transfer guide unit includes a straight portion having a straight passage and a curved portion having a curved passage.

One end of the straight passage is connected to the paper sheet sending-out unit and another end of the straight passage is connected to one end of the curved passage.

The curved portion is curved at an angle of not less than 90° with respect to the straight portion, and has an inwardly indented curved surface and an outwardly projected curved surface arranged to face the inwardly indented curved surface to form the curved passage.

The inwardly indented curved surface is arranged such that the paper sheet which is sent out by the paper sheet sending-out unit and transferred through the straight passage is slidably in contact with the inwardly indented curved surface so as to change a transfer direction of the paper sheet.

The inwardly indented curved surface has a plurality of ribs arranged in a transverse direction crossing the transfer direction of the paper sheet in the curved passage and extending in the transfer direction.

The inwardly indented curved surface further has a cross section that extends in the transverse direction and has a central region and two side regions located at respective sides of the central region in the transverse direction.

Not more than three of the ribs are arranged in the central region and a remainder of the plurality of ribs are arranged in the two side regions.

The number of the ribs in each of the side regions is larger than the number of the ribs in the central region.

The not more than three ribs in the central region have the same height with respect to each other and is larger in height than each of the remainder of the ribs in the two side regions.

The straight passage and the curved passage have a total length which is shorter than a length of the paper sheet in the transfer direction of the paper sheet in the straight passage and the curved passage.

The recording medium supplying apparatus further comprises a register unit which is arranged at another end of the curved passage, with which a leading end of the paper sheet discharged from another of the curved passage is in contact so that a portion of the paper sheet facing the inwardly indented curved surface is pressed on the inwardly indented curved surface at the central region of the cross section while the paper sheet is sent out from another end of the curved passage and the leading end of the paper sheet contacts the register unit, whereby the paper sheet is slid on the inwardly indented curved surface at the central region of the cross section to register the paper sheet to the printing unit when the paper sheet skews in the straight passage and the curved passage, and the register unit allows the paper sheet to pass toward the printing unit in a predetermined timing after the paper sheet is registered.

With this structure, when a bend is produced in the recording medium such that the register unit prevents the recording medium from moving, and a peak of the bend contacts the recording medium contact portion of the recording medium transfer guide unit, the contact occurs only at the central region of the portion and does not occur at opposite sides of the central region. Moreover, only not more than three ribs are arranged in the central region. Accordingly, the friction force generated between the portion of the guide member of the recording medium transfer guide unit and the peak of the bend of the recording medium due to the contact is generated only between not more than three ribs in the central region of the portion of the guide member and the peak of the bend. Therefore, even if the recording medium skews, the recording medium can be easily turned to correct the skew.

In the apparatus, any recording medium skewing will not be supplied by the register unit to the recording unit such as a printing unit. As a result of this, information can be precisely recorded on the recording medium. Further, the recording medium will not be wrinkled, and thus clogging of the recording medium in the recording medium transferring passage will not occur.

In the recording medium supplying apparatus according to the invention and structured as described above, it is preferable that the heights of the remainder of the ribs in each side region decrease as a position of each of the remainder of the ribs is farther away from the central region in the transverse direction.

The recording medium contact portion of the recording medium transfer guide unit structured as above, further decreases the frictional force generated between it and the recording medium slidingly contacting thereon.

Alternatively, the ribs arranged in the each side region may have the same height but less than that in the central region.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 8:
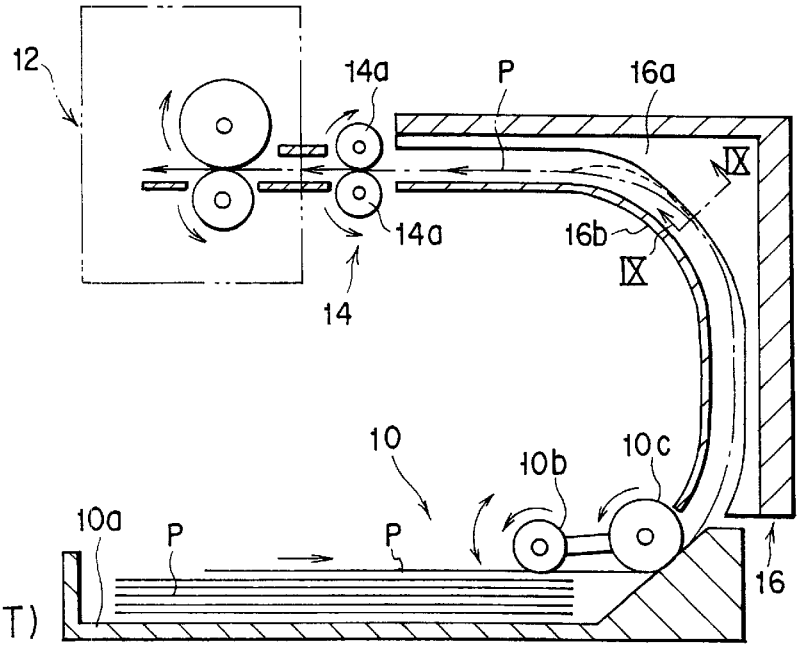
FIG.8 (PRIOR ART)
FIG. 8 is a vertical sectional view schematically showing a conventional recording medium supplying apparatus.
Figure 9:
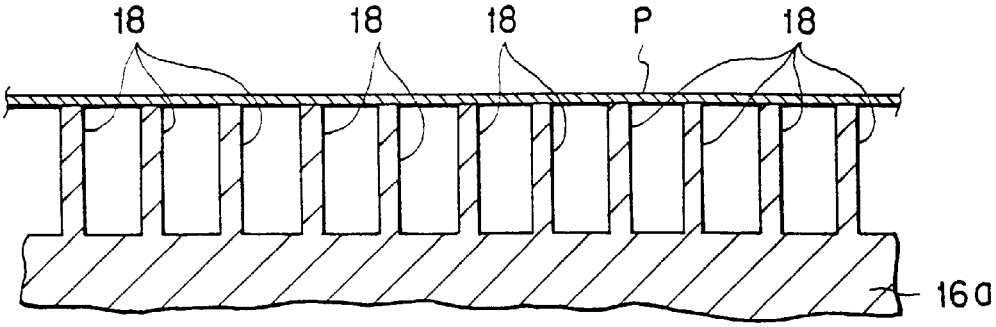
FIG. 9 (PRIOR ART)
FIG. 9 is a cross sectional view taken along a line IX—IX in FIG. 8.
Figure 10:
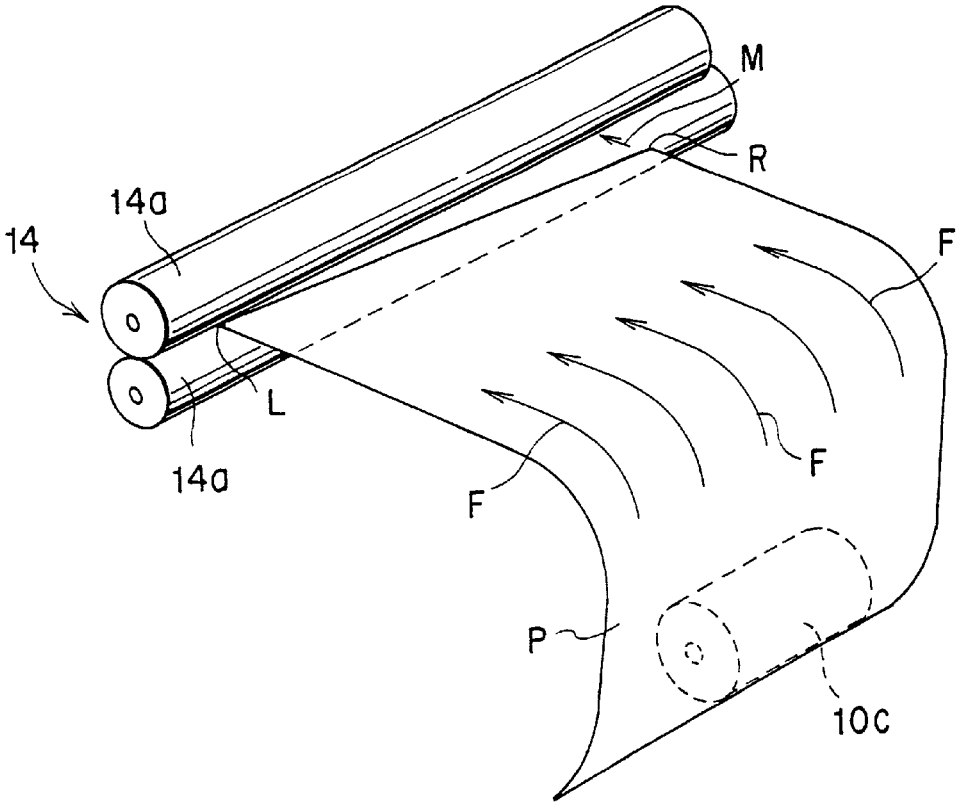
FIG. 10 (PRIOR ART)
FIG. 10 is a perspective view schematically showing an operation of a register unit of the conventional recording medium supplying apparatus shown in FIG. 8.

A recording medium supplying apparatus according to one embodiment of the present invention will be described in detail with reference to FIGS. 1 to 4. Most of components of the apparatus of the present invention are the same as those of the conventional apparatus described above with reference to FIGS. 8 to 10. Therefore, the same or like components in the apparatus according to one embodiment of the present invention as those in the above described conventional apparatus are designated by the same reference numerals as those used to designate the corresponding components in the conventional apparatus, and the detailed description of the same or like components of the apparatus of the one embodiment of the present invention are omitted.

The recording medium supplying apparatus according to one embodiment of the present invention differs from the above described conventional apparatus in a shape of a cross section of an inwardly indented curved portion of one guide member 16*a*' of a recording medium transfer guide unit 16'. The curved portion is a portion of the one guide member 16*a*' against which a peak of a bend of a recording medium P is pushed when a leading end of the recording medium P contacts a contact line between a pair of register rollers 14*a*, 14*a* of a register unit 14, moving of the recording medium P by a sending-out roller 10*c* is stopped, and the recording medium P is bent as shown by a dotted line in FIG. 1. As stated in the description of the conventional apparatus, the bend of the recording medium P may easily occur particularly in the curved portion of a recording medium moving passage in the recording medium transfer guide unit 16', i.e., at that portion the moving direction of the recording medium P is changed. In this embodiment, the recording medium P is a paper sheet as in the above described conventional apparatus.

Figure 2:
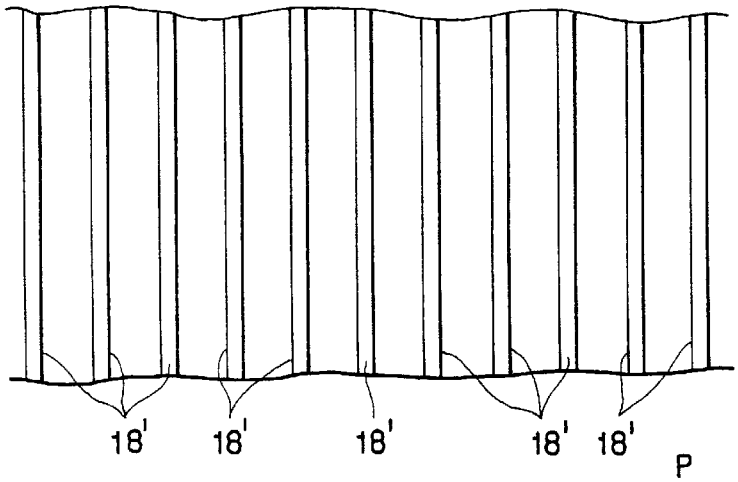
FIG. 2 is an enlarged front view of a part of an inwardly indented curved surface of one guide member, the guide member being provided in a recording medium transfer guide unit of the recording medium supplying apparatus of FIG. 1.

Also In this embodiment as in the above described conventional apparatus, the entire sliding contact surface of the one guide member 16*a*' which faces another guide member 16*b* of the recording medium transfer guide unit 16' is structured by projecting end surfaces of a plurality of ribs 18'. And, the ribs are spaced apart from each other at substantially the same intervals in a direction which is along the contact surface of the one guide member 16*a*' and perpendicular to the moving direction of the sheet P in the recording medium transfer guide unit 16', and extend in the moving direction of the sheet P, as shown in FIG. 2.

Figure 3:
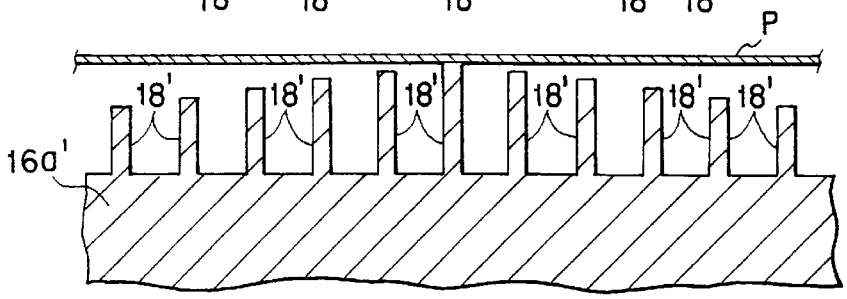
FIG. 3 is a cross sectional view of the inwardly indented curved surface of the guide member, taken along a line III—III in FIG. 1.

As is clearly shown in FIG. 3, the present invention is characterized by a cross section of the one portion (curved portion) of the one guide member 16*a*'. That is, one rib 18' arranged in the central region in the direction which is along the contact surface of the one guide member 16*a*' and perpendicular to the moving direction of the sheet P, protrudes higher than the other ribs 18' arranged on both sides of the central region. More specifically, the ribs 18' arranged on each of the sides of the central region are formed such that the heights of the ribs arranged on each of the sides of the central region decrease stepwisely as the positions of the ribs are farther away from the central region. That is, in the cross section of FIG. 3, two lines each connecting the projecting end surfaces of the ribs arranged on each of the sides of the central region are taperingly inclined with regard to a plane of the sheet P slidingly contacting a projecting end surface of one rib 18' arranged in the central region.

A cross section of the other portion (a vertically raising straight portion extending from an inlet of the recording medium transfer guide unit 16' adjacent to a sending-out roller 10*c* to the bending or curved portion, and a horizontal straight portion extending from the bending or curved portion to an outlet of the transfer guide unit 16' adjacent to the paired register rollers 14*a*, 14*a* of the register unit 14) of the guide member 16*a*' is formed similarly to that of the conventional apparatus. That is, projecting end surfaces of the plurality of ribs 18' structuring the sliding contact surface of the other portion of the guide member 16*a*' are arranged in the same plane so that all of the projecting end surfaces of the plurality of ribs 18' covered by the sheet P slidingly contacting the sliding contact surface of the other portion can slidingly contact the sheet P to make the sheet P move stably in the other portion.

As in the conventional apparatus, in the apparatus according to this embodiment and structured as described above, when the sheet P is discharged from the outlet of the recording medium transfer guide unit 16', the leading end of the sheet P contacts the contact line between the paired register rollers 14*a*, 14*a* of the register unit 14 and the movement of the sheet P by the sending-out roller 10*c* is stopped. At this time, if the sheet P skews with regard to the contact line, a moment M is produced in the sheet P in which a moving force F1 is applied by the sending-out roller 10*c* to turn sheet P around one corner L of the leading end contacting the contact line and to move another corner R which does not contact the contact line toward the contact line.

Figure 1:
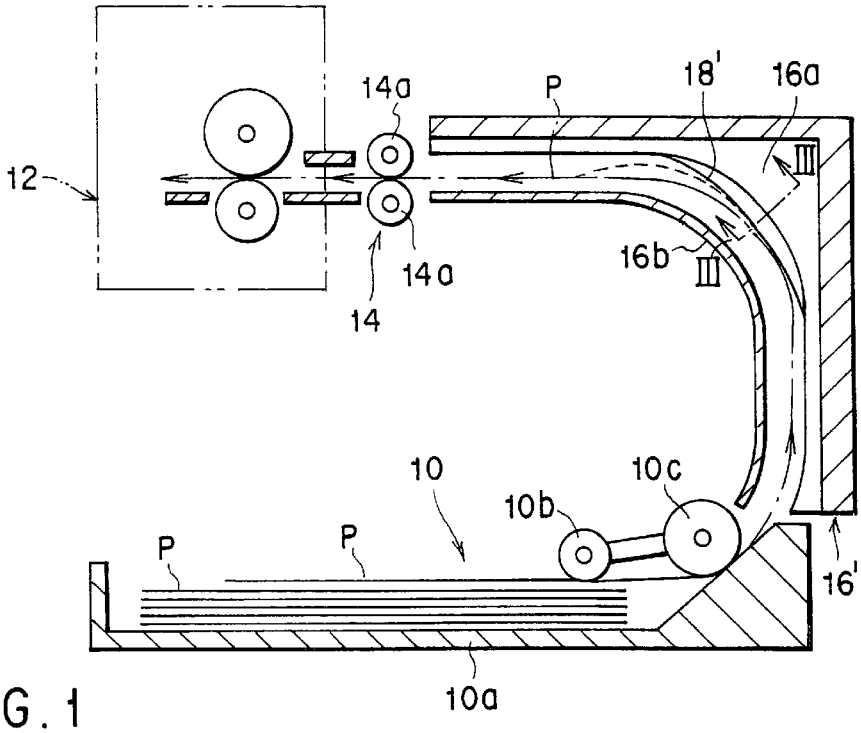
FIG. 1 is a vertical sectional view schematically showing a recording medium supplying apparatus according to one embodiment of the present invention.

In this situation, since the sheet P is still applied with the moving force F1 by the sending-out roller 10*c* even after the leading end of the sheet P has been in contact with the contact line between the paired register rollers 14*a*, 14*b* of the register unit 14, the sheet P is bent as shown in FIG. 1 by a dotted line, and a peak of the bend is pushed against the sliding contact surface of the bending or curved portion of the one guiding member 16*a*' of the recording medium transfer guide unit 16'. At this time, the peak of the bend, however, contacts only the projecting end surface of the rib 18' arranged in the central region in the direction which is along the sliding contact surface and perpendicular to the moving direction of the sheet P, and does not contact projecting end surfaces of the ribs 18' on the both sides of the central region.

Figure 4:
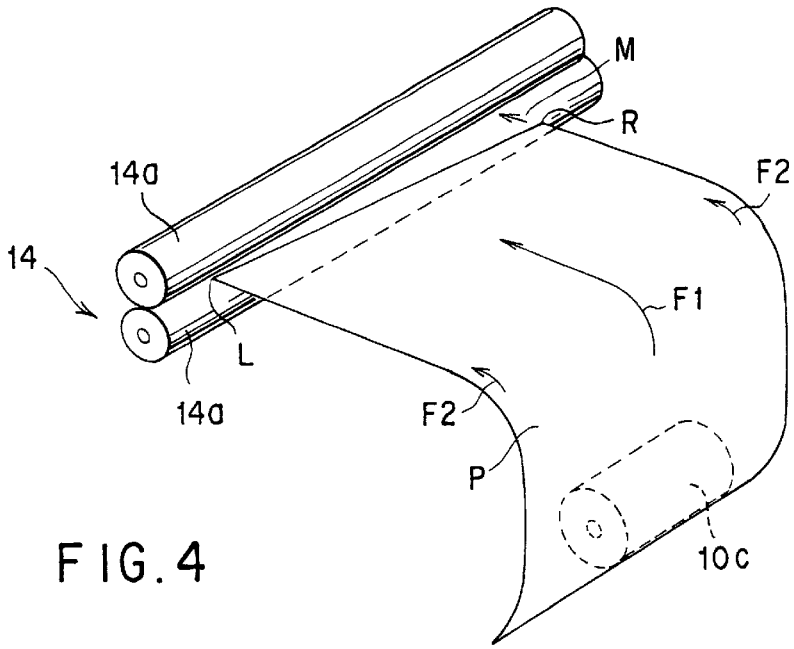
FIG. 4 is a perspective view schematically showing an operation of a register unit of the recording medium supplying apparatus in FIG. 1.

As is clearly shown in FIG. 4, a friction F2 which is generated between the projecting end surfaces of the ribs 18' arranged on both sides of the central region and both sides of a central region of the sheet P in its width direction perpendicular to the moving direction thereof, is quite smaller than a friction F1 which is generated between the projecting end surface of one rib 18' arranged in the central region and the central region of the sheet P in its width direction. In this structure, when the sheet P skews, the sheet P can be easily turned in the direction which is along the sliding contact surface and perpendicular to the moving direction of the sheet P, to correct the skew of the sheet P while the peak of the bend of the sheet P is pushed only against the projecting end surface of one rib 18' arranged in the central region of the plurality of ribs 18' of the one guide member 16*a*' of the recording medium transfer guide unit 16'.

In this manner, the sheet P is supplied by the register unit 14 to the printing unit 12 after the skew of the sheet P has been surely corrected. Therefore, the shift of the image on the sheet P will not occur, the sheet P will not be wrinkled, and clogging of the sheet P in the recording medium moving passage of the recording medium transfer guide unit 16' will not occur.

Figure 5:
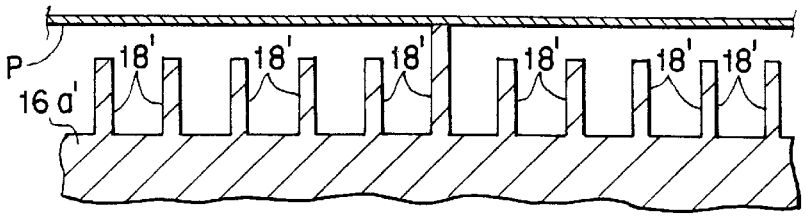
FIG. 5 is a sectional view showing a main portion of a first modification of the inwardly indented curved surface of the guide member, taken along the same line as indicated in FIG. 3.

FIG. 5 is a sectional view showing a main portion of a first modification of the recording medium supplying apparatus according to the one embodiment of the present invention, taken along the same line indicated in FIG. 3.

In this modification, the cross section of the one portion (the bending or curved portion) of the one guide member 16*a*' of the recording medium transfer guide unit 16' is formed as shown in FIG. 5. That is the plurality of ribs 18' arranged on both sides of the central region in the direction which is along the sliding contact surface and perpendicular to the moving direction of the sheet P, have the same height less than that of one rib 18' in the central region. Also in this structure, one rib 18' arranged in the central region protrudes higher than the ribs 18' on both sides of the central region.

Alternately, as long as one rib 18' arranged in the central region projects more than the ribs 18' arranged on both sides of the central region, the ribs 18' arranged on both sides of the central region may decrease in their heights as the position of the rib 18' is farther away from the central region in units of two or three ribs 18'. Further, the ribs 18' arranged on both sides of the central region may have various heights different from each other.

Figure 6A:
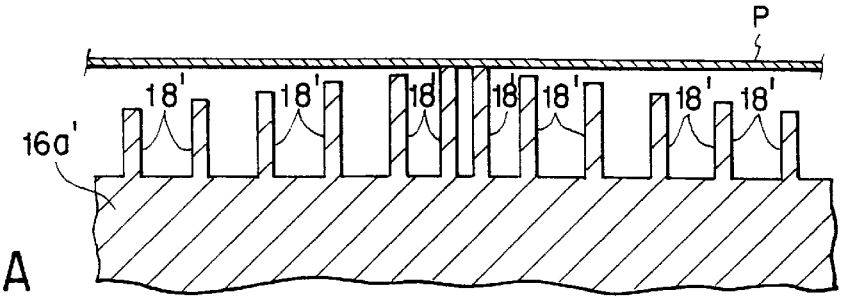
FIG. 6A is a sectional view showing a main portion of a second modification of the inwardly indented curved surface of the guide member, taken along the same line as indicated in FIG. 3.

FIG. 6A is a sectional view showing a main portion of a second modification of the recording medium supplying apparatus according to the one embodiment of the present invention, taken along the same line indicated in FIG. 3.

In this modification, the cross section of the one portion (the bending or curved portion) of the one guide member 16*a*' of the recording medium transfer guide unit 16' is formed as shown in FIG. 6A. That is, two ribs 18' having the same height as to each other are arranged in the central region. And, the plurality of ribs 18' arranged in each side region decrease their heights as a position of each of the ribs 18' is farther away from the central region in the transverse direction perpendicular to the moving direction of the paper sheet P.

Figure 6B:
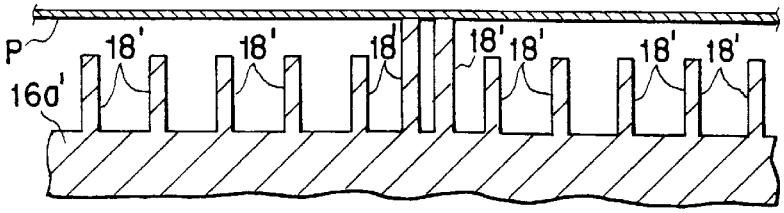
FIG. 6B is a sectional view showing a main portion of a third modification of the inwardly indented curved surface of the guide member, taken along the same line as indicated in FIG. 3.

FIG. 6B is a sectional view showing a main portion of a third modification of the recording medium supplying apparatus according to the one embodiment of the present invention, taken along the same line indicated in FIG. 3.

In this modification, the cross section of the one portion (the bending or curved portion) of the one guide member 16*a*' of the recording medium transfer guide unit 16' is formed as shown in FIG. 6B. That is, two ribs 18' having the same height as to each other are arranged in the central region. And the plurality of ribs 18' arranged in each side region have the same height less than that of two ribs 18' in the central region.

Figure 7A:
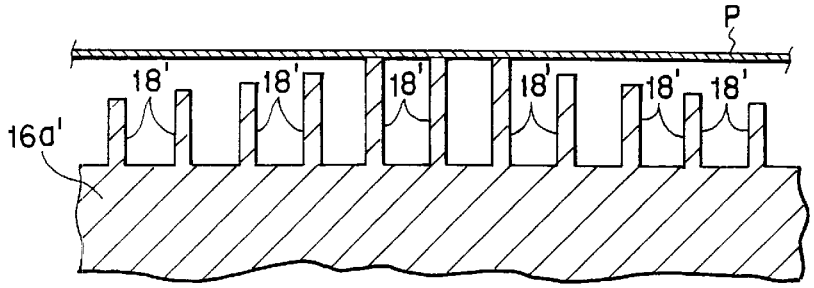
FIG. 7A is a sectional view showing a main portion of a fourth modification of the inwardly indented curved surface of the guide member, taken along the same line as indicated in FIG. 3.

FIG. 7A is a sectional view showing a main portion of a fourth modification of the recording medium supplying apparatus according to the one embodiment of the present invention, taken along the same line indicated in FIG. 3.

In this modification, the cross section of the one portion (the bending or curved portion) of the one guide member 16*a*' of the recording medium transfer guide unit 16' is formed as shown in FIG. 7A. That is, three ribs 18' having the same height as to each other are arranged in the central region. And, the plurality of ribs 18' arranged in each side region decrease their heights as a position of each of the ribs 18' is farther away from the central region in the transverse direction perpendicular to the moving direction of the paper sheet P.

Figure 7B:
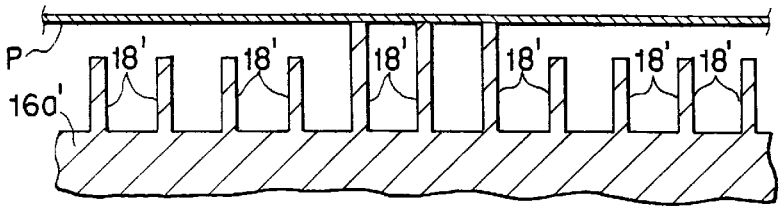
FIG. 7B is a sectional view showing a main portion of a fifth modification of the inwardly indented curved surface of the guide member, taken along the same line as indicated in FIG. 3.

FIG. 7B is a sectional view showing a main portion of a fifth modification of the recording medium supplying apparatus according to the one embodiment of the present invention, taken along the same line indicated in FIG. 3.

In this modification, the cross section of the one portion (the bending or curved portion) of the one guide member 16*a*' of the recording medium transfer guide unit 16' is formed as shown in FIG. 7B. That is, three ribs 18' having the same height as to each other are arranged in the central region. And the plurality of ribs 18' arranged in each side region have the same height less than that of three ribs 18' in the central region.

The modifications structured in the above described manner can perform the same operation and can attain the same advantage as those of the recording medium supplying apparatus according to the aforementioned one embodiment and described above with reference to FIGS. 1 to 4.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A paper sheet supplying apparatus for preventing a paper sheet from skewing as the sheet is fed, the apparatus comprising:

a paper sheet sending-out unit for sending out the paper sheet, a paper sheet transfer guide unit for guiding the paper sheet sent out by the sending-out unit, the paper sheet transfer guide unit including a straight portion having a straight passage and a curved portion having a curved passage, a first end of the straight passage being connected to the paper sheet sending-out unit and a second end of the straight passage being connected to a first end of the curved passage, the curved portion being curved at an angle of not less than 90° with respect to the straight portion, the curved portion having an inwardly indented curved surface and an outwardly projected curved surface which faces the inwardly indented curved surface to form the curved passage, the paper sheet is adapted to slidably engage the inwardly indented curved surface so as to change a transfer direction of the paper sheet, the inwardly indented curved surface having a plurality of ribs spaced from one another in a direction transverse to the transfer direction of the paper sheet, the inwardly indented curved surface having a cross section that extends in the transverse direction and having a central region and two side regions located at respective opposite sides of the central region in the transverse direction;

not more than three of the plurality of ribs being arranged in the central region and a remainder of the plurality of ribs being divided among the two side regions to form a first group and a second group of said plurality of ribs;

each of the first and second groups of said plurality of ribs being larger in number than the number of the ribs in the central region, each of the not more than three of the plurality of ribs in the central region having a height with respect to the inwardly indented curved surface which is larger than a height of each of the ribs in the first and second groups along the entire length of the inwardly indented curved surface in the transfer direction, and the straight passage and the curved passage defining a total passage length which is shorter than a length of the paper sheet in the transfer direction of the paper sheet; and a register unit being connected to a second end of the curved passage and adapted to contact a leading end of the paper sheet so that a portion of the paper sheet facing the inwardly indented curved surface is pressed on the inwardly indented curved surface at the central region thereof while the paper sheet is sent out from the paper sheet sending-out unit to correct a skew of the paper sheet with respect to the transfer direction and properly register the paper sheet to a printing unit, and the register unit enables the paper sheet to pass toward the printing unit in a predetermined timing after the paper sheet is registered.

2. A paper sheet supplying apparatus according to claim 1, wherein the not more than three of the plurality of ribs is at least two of said plurality of ribs.

3. A paper sheet supplying apparatus according to claim 2, wherein the height of each of the ribs of the first and second groups of said plurality of ribs decreases as a position of each of the ribs of the first and second groups of said plurality of ribs is farther away from the central region in the transverse direction.

4. A paper sheet supplying apparatus according to claim 1 wherein the not more than three of the plurality of ribs is one of said plurality of ribs.

5. A paper sheet supplying apparatus according to claim 4, wherein the height of each of the ribs of the first and second groups of said plurality of ribs decreases as a position of each of the ribs of the first and second groups of said plurality of ribs is farther away from the central region in the transverse direction.

* * * * *

UNITED STATES PATENT AND TRADEMARK OFFICE

CERTIFICATE OF CORRECTION

PATENT NO. : 6,149,045
DATED : November 21, 2000
INVENTOR(S) : Takeshi Kadono

It is certified that error appears in the above-identified patent and that said Letters Patent is hereby corrected as shown below:

Title page,
Item [22] Filed, change "Apr. 2, 1999" to -- Mar. 11, 1999 --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*